US009840107B2

(12) United States Patent
Rudelman et al.

(10) Patent No.: US 9,840,107 B2
(45) Date of Patent: Dec. 12, 2017

(54) DISSOLVABLE INK-SUPPORT SHEET MATERIAL

(71) Applicant: Moises Rudelman, Dallas, TX (US)

(72) Inventors: Moises Rudelman, Dallas, TX (US); Michael David Hilston, Painesville, OH (US); Berryinne Decker, Macedonia, OH (US)

( * ) Notice: Subject to any disclaimer, the term of this patent is extended or adjusted under 35 U.S.C. 154(b) by 0 days.

(21) Appl. No.: 14/208,285

(22) Filed: Mar. 13, 2014

(65) Prior Publication Data

US 2014/0272236 A1 Sep. 18, 2014

Related U.S. Application Data

(60) Provisional application No. 61/791,153, filed on Mar. 15, 2013.

(51) Int. Cl.
*B44C 1/17* (2006.01)
*B44C 1/175* (2006.01)

(52) U.S. Cl.
CPC ..... *B44C 1/175* (2013.01); *Y10T 428/1467* (2015.01); *Y10T 428/24802* (2015.01); *Y10T 428/24868* (2015.01); *Y10T 428/24934* (2015.01)

(58) Field of Classification Search
CPC ..... Y10T 428/24868; Y10T 428/1467; Y10T 428/24934; Y10T 428/24802; Y10T 428/14; Y10T 428/1486; B44C 1/17; B44C 1/175; B44C 1/1708; B44C 1/172; B44C 1/1733; B44C 1/1741; B44C 1/1754; B44C 1/1758
See application file for complete search history.

(56) References Cited

U.S. PATENT DOCUMENTS 1,797,998 A * 3/1931 Sadtler ..... B44C 1/175 156/278
2,654,170 A * 10/1953 Nestor ..... G09F 3/02 156/DIG. 8
3,669,704 A * 6/1972 Reiling ..... B44C 1/175 428/202

(Continued)

FOREIGN PATENT DOCUMENTS

WO WO 2013078380 A1 * 5/2013 ..... G09F 3/02

OTHER PUBLICATIONS

Definition of vehicle, www.dictionary.com, May 25, 2017.*

*Primary Examiner* — Patricia L Nordmeyer
(74) *Attorney, Agent, or Firm* — David H. Judson

(57) ABSTRACT

A sheet material for use as a dissolvable decal comprises a dissolvable paper or polymer layer whose dissolvability in water is enhanced using a temporary water barrier. In one embodiment, the sheet material comprises a dissolvable paper stock layer coated with the temporary water barrier layer in the form of an acrylate polymer. To create the decal, one or more ink layers are applied, either on top of the temporary water barrier, or between the temporary water barrier and a top face of the dissolvable paper stock. The sheet material also comprises a removable release liner comprising a sheet with a silicone release coating on one side. In use, the paper/plastic liner is removed and the resulting decal is then positioned on a vehicle. The decal remains on the vehicle, but it is ultimately removable under high pressure water conditions.

9 Claims, 1 Drawing Sheet

(56) References Cited

U.S. PATENT DOCUMENTS

| | | | | |
|---|---|---|---|---|
| 5,472,757 | A * | 12/1995 | Ogawa | B41M 5/504 347/105 |
| 2009/0117377 | A1 * | 5/2009 | Hacikyan | B32B 7/12 428/352 |
| 2009/0286032 | A1 * | 11/2009 | Franklin | G09F 3/0291 428/41.8 |

* cited by examiner

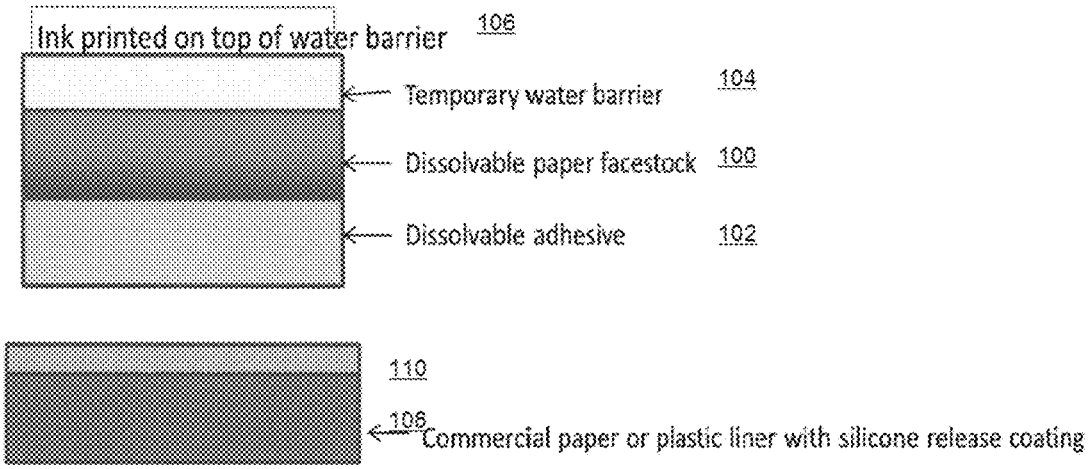
Ink printed on top of water barrier
106
Temporary water barrier
104
Dissolvable paper facestock
100
Dissolvable adhesive
102
110
108
Commercial paper or plastic liner with silicone release coating

DISSOLVABLE INK-SUPPORT SHEET MATERIAL

BACKGROUND

Technical Field

The subject disclosure relates generally to a temporary (wash-away) decal that is adapted to be affixed to a vehicle (or similar object) and that remains visible during adverse weather conditions (e.g., rain) but is later removable through application of higher water pressures (e.g., from a car wash).

Background of the Related Art

Automobile owners often desire to decorate their vehicles with decals or other stickers. These items typically are positioned on vehicle surfaces (e.g., bumpers) where they can be removed. Because decals/stickers of this type often remain for long periods of time (sometimes years or longer), they are affixed with strong adhesives. As such, in the past it has not been possible to provide a "temporary" or short-term solution in the form of a temporary decal that can be readily applied to the vehicle but then easily removed by the owner.

BRIEF SUMMARY

A sheet material for use as a dissolvable (or wash-away) decal comprises a dissolvable layer (e.g., paper or plastic) whose dissolvability in water is enhanced (built-up) using a temporary water barrier. In one embodiment, the sheet material comprises a dissolvable paper stock layer coated with the temporary water barrier layer in the form of an acrylate polymer. The temporary water barrier may also penetrate into the paper itself. To create the decal, one or more ink layers (representing text, a graphic, an image, or the like) are applied, either on top of the temporary water barrier, or between the temporary water barrier and a top face of the dissolvable paper stock. The sheet material also comprises a removable release liner comprising a paper or plastic sheet with a silicone release coating on one side. In use, the paper/plastic liner is removed and the resulting decal (comprising the ink/barrier/paper/adhesive layers) is then positioned on a vehicle. The decal remains on the vehicle and visible even under in-climate weather, but it is ultimately removable under high pressure water conditions (e.g., a car wash, a direct water spray, or the like).

The foregoing has outlined some of the more pertinent features of the disclosed subject matter. These features should be construed to be merely illustrative. Many other beneficial results can be attained by applying the disclosed subject matter in a different manner or by modifying the subject matter as will be described.

BRIEF DESCRIPTION OF THE DRAWINGS

For a more complete understanding of the present invention and the advantages thereof, reference is now made to the following descriptions taken in conjunction with the accompanying drawings, in which:

FIG. 1 is an elevation view of the temporary wash-away decal of this disclosure.

DETAILED DESCRIPTION OF AN ILLUSTRATIVE EMBODIMENT

FIG. 1 is an elevation view of the temporary wash-away decal of this disclosure. The decal comprises a set of layers. In one embodiment, a main or primary layer 100 comprises a dissolvable paper facestock, typically formed of cellulose and a water-soluble binder. Typically, layer 100 has a top face (upwardly- or outwardly-facing in the drawing) and an opposed bottom face. Affixed to layer 100 is a dissolvable adhesive layer 102, typically formed of an acrylic copolymer. Layer 102 may be directly coated onto the bottom of layer 100, or it may be applied to layer 110 in a lamination process. On top of layer 100 is a temporary water barrier layer 104, typically formed of an acrylate polymer that provides a degree of water-resistance to the dissolvable paper facestock layer 100. The layer 104 may be coated on top of the layer 100; in the alternative, the material comprising the temporary water barrier may be applied in a solution so that the active material penetrates into the layer 100. The basic function of the temporary water barrier 104 is to adjust (increase) the resistance to dissolvability of the dissolvable paper layer. In other words, by affixing the water barrier layer 104 (to the dissolvable paper), the degree to which the primary layer 100 dissolves is adjusted so as to trade-off the layer 100 never dissolving (being too water-resistant) or dissolving too fast (not being sufficiently water-resistant). This enables the decal to have a careful balance between the degree to (and rate at) which the layer 100 dissolves in typical environmental conditions wherein an average degree of rainfall is expected. In particular, a goal of this construction is to enable the decal to remain affixed and readable even through rainy days, yet be fully and easily removable under higher pressure water conditions, such as those that exist in a car wash.

To create the decal's text, graphics or image, one or more ink layers 106 (representing text, a graphic, an image, or the like) are applied, either on top of the temporary water barrier 104, or between the temporary water barrier 104 and a top face of the dissolvable paper stock 100. If the ink is water soluble, then the ink should be applied in-between the layers 104 and 100. If the ink is not water-soluble, then it can be applied above layer 104, or in-between layers 104 and 100.

The sheet material also comprises a removable release liner typically comprising of a paper or plastic sheet 108 with a silicone release coating 110. The purpose of the release liner is to protect the adhesive until the time of decal application. Typical thickness for the sheet 108 is 0.5-5.0 mils, and 0.1-0.5 mils for the silicone release coating.

The decal is created by laminating layers 100-102-104-106 to layers 108-110, or by laminating layers 100-104-106 to layers 102-110-108. The result is a temporary wash-away decal comprising the resulting laminate structure.

In use, the paper/plastic liner 110 is removed (from the laminate) and the resulting decal (comprising the ink/barrier/paper/adhesive layers) is then positioned on a vehicle. The decal remains on a vehicle (or other outdoor structure and visible even under usual rainy conditions, but it is ultimately removable under high pressure water conditions (e.g., a car wash, a direct water spray, or the like).

Sheet material comprising layers 100-102-104 laminated to layers 108-110 (without the ink layers 106) are also within the scope of this disclosure.

Representative materials for layer 100 include, without limitation, DissolvTech 35 paper (from DayMark Technologies), and DissolvTech PS paper.

Representative materials for layer 102 include, without limitation, AMPHOMER® polymer from AkzoNobel, RESYN® 28-2930 Polymer from AkzoNobel, and DERMACRYL® 79 Film Forming Polymer, from Akzo Nobel.

Representative materials for layer 104 include, without limitation, E5800 from Avery Dennison.

In an alternative embodiment, and in lieu of dissolvable paper, a water-soluble polymer layer may be used. In this embodiment, layer 100 (in the drawing) is replaced with a layer of dissolvable plastic material. Preferably, the material has a uniform caliper (thickness) with good mechanical characteristics so that it may be processed as a web (e.g., on an adhesive coating machine). The material is printable (and thus can receive the ink layer), and it may be treated with the coating (as described above) to adjust its rate of dissolvability as appropriate for the desired use. The thickness of the layer 100 in this embodiment may vary but typically is between 25-50 microns. Representative polymer materials include Solubron™ PVAL films (e.g., BP, KA, TF and GA grade), Soltec™ PVAL films (e.g., HH, SE6 and WWS grade), Monosol™ dissolvable plastic, and others. In this alternative embodiment, the water barrier 104 and adhesive layers 102 are used.

In yet another alternative embodiment, the active layer includes multiple dissolvable layers, with each layer being one of: a dissolvable paper layer or material, and a dissolvable polymer layer or material.

A decal (or more generally, a material) that exhibits the above-described physical characteristics and properties may be used for promotional purposes, for advertising and display purposes, for informational purposes, for aesthetic purposes in modifying the appearance of the vehicle or object, or the like.

Having described the invention, what we now claim is as follows:

1. Sheet material, comprising:

a water-dissolvable layer that dissolves by application of water;

a water barrier layer having an active acrylate polymer material penetrated into a portion of the water-dissolvable layer to increase resistance of the water-dissolvable layer to dissolvability by water;

an ink layer; and a dissolvable adhesive layer underlying the water-dissolvable layer.

2. The sheet material as described in claim 1 wherein the water-dissolvable layer is one of: a dissolvable paper layer, and a dissolvable polymer layer.

3. The sheet material as described in claim 2 wherein the dissolvable paper layer comprises cellulose and a water-soluble binder.

4. The sheet material as described in claim 1 wherein the water barrier layer is affixed atop the water-dissolvable layer.

5. The sheet material as described in claim 1 wherein the dissolvable adhesive layer comprises an acrylic co-polymer.

6. The sheet material as described in claim 1 further including a removable paper or plastic liner.

7. The sheet material as described in claim 1 wherein the ink layer comprises one of: text, a graphic, and an image.

8. The sheet material as described in claim 7 wherein the ink layer is applied over the water barrier layer.

9. The sheet material as described in claim 7 wherein the ink layer is applied between the water barrier layer and the water-dissolvable layer.

* * * * *